US007607420B2

(12) United States Patent
Ueda et al.

(10) Patent No.: US 7,607,420 B2
(45) Date of Patent: Oct. 27, 2009

(54) FUEL-EVAPORATED GAS PROCESSING SYSTEM AND ELECTROMAGNETIC VALVE DEVICE

(75) Inventors: Masatoshi Ueda, Tokyo (JP); Tatsuya Matsumoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 119 days.

(21) Appl. No.: 11/988,233

(22) PCT Filed: May 25, 2006

(86) PCT No.: PCT/JP2006/310482

§ 371 (c)(1),
(2), (4) Date: Jan. 3, 2008

(87) PCT Pub. No.: WO2007/020736

PCT Pub. Date: Feb. 22, 2007

(65) Prior Publication Data

US 2009/0078238 A1 Mar. 26, 2009

(30) Foreign Application Priority Data

Aug. 12, 2005 (JP) ..... 2005-234342

(51) Int. Cl.
*F02M 33/02* (2006.01)

(52) U.S. Cl. ..... 123/520

(58) Field of Classification Search ..... 123/516, 123/518, 519, 520

See application file for complete search history.

(56) References Cited

U.S. PATENT DOCUMENTS 4,703,737 A * 11/1987 Cook et al. ..... 123/520
5,284,121 A 2/1994 Abe et al.
5,509,395 A * 4/1996 Cook ..... 123/518
5,697,348 A * 12/1997 Schwager ..... 123/520
5,941,218 A * 8/1999 DeLand et al. ..... 123/520
2004/0011409 A1* 1/2004 Martus et al. ..... 137/557

FOREIGN PATENT DOCUMENTS

JP 4-164146 A 6/1992
JP 5-10767 U 2/1993
JP 5-86923 A 4/1993
JP 05-332205 12/1993
JP 6-46017 B2 6/1994
JP 06-272582 9/1994
JP 06-272628 9/1994
JP 7-83129 A 3/1995

* cited by examiner

*Primary Examiner*—Thomas N Moulis
(74) *Attorney, Agent, or Firm*—Birch, Stewart, Kolasch & Birch, LLP

(57) ABSTRACT

A fuel-evaporated gas processing system includes an input port taking in evaporated gas evaporated in a fuel tank; output ports supplying the evaporated gas taken in through the input port to an intake system of an engine; a chamber interposed between the input port and the output ports; an electromagnetic valve device including at least first and second electromagnetic valves disposed in the connection between the input port or the output ports and the chamber, either of the input port or the output ports being branched off into a plurality of sections, and perform opening and closing operations in response to a driving signal; and a valve control means driving the first and the second electromagnetic valves of the electromagnetic valve device.

16 Claims, 12 Drawing Sheets

DUTY-FLOW RATE CURVE (IN FORWARD REVERSE SUCTION)

DUTY-FLOW RATE CURVE (IN FORWARD REVERSE SUCTION)

FUEL-EVAPORATED GAS PROCESSING SYSTEM AND ELECTROMAGNETIC VALVE DEVICE

TECHNICAL FIELD

The present invention relates to a fuel-evaporated gas processing system and an electromagnetic valve device controlling the flow rate of evaporated gas from a fuel tank to be fed to an intake system of a motor engine.

BACKGROUND ART

In general, an intake system of a motor engine is arranged to be fed with evaporated gas evaporated within a fuel tank. A feeding path therefor is called as a purge passage, and consists of the fuel tank; a canister taking in the evaporated gas evaporated in a fuel tank and temporarily adsorbing the gas therein; and a series of piping connecting the main elements such as the intake system of the engine etc, receiving the evaporated gas (purge gas) discharged from the canister. Further, an electromagnetic valve used for duty control of the flow rate of the purge gas is provided between the canister of the purge passage and the intake system of the engine.

Here, suppose that the intake system of the engine and the canister are connected by means of a single piping; a single electromagnetic valve is provided therebetween; and the electromagnetic valve is intermittently open and close controlled (duty control), to thereby control the flow rate of the purge gas flowing through the purge passage, the intermittent opening and closing of the electromagnetic valve produces pressure pulsations in the purge passage, and due to this, it makes nonuniform the feed rate of the purge gas relative to intake air and fuel mixtures into the engine, thus degrading the control of an air fuel ratio. Further, the purge passage leading from the fuel tank to the intake system of the engine through the canister and electromagnetic valve, and the electromagnetic valve are mounted on the vehicle. Therefore, vibrations originated from the pressure pulsations in the purge passage are propagated to inside the vehicle and generate noises therein.

Furthermore, in recent years, there has been a demand for the increased flow rate of the purge passage. The increased flow rate augments the pressure pulsations in the purge passage, and this has a tendency for the above-mentioned problems to be serious.

For that reason, it is conceivable to increase a control frequency for the duty control of the electromagnetic valve, as a method of reducing the pressure pulsations in the purge passage by using a single electromagnetic valve, e.g., to increase the control frequency from 10 Hz to 20 Hz.

However, although the method can reduce the pressure pulsations, the durability of the electromagnetic valve is decreased for the increased number of times of operation per unit time. Moreover, increasing the control frequency shifts a duty ratio that enables the electromagnetic valve to rise from a closed state to an opened state, to a high ratio, narrowing the control range and lowering the control resolution consequently.

With such circumstances as the background, various fuel-evaporated gas processing systems have been proposed so far, which have a structure where their purge passage is forked halfway at least into two directions as conventional fuel-evaporated gas processing systems. In all of those systems, an electromagnetic valve is provided in each of the pipes of the branched purge passages, and the electromagnetic valve is open and close driven by a duty control method in each of the branched purge passages. This reduces the purge gas supply of the flow rate to an intake system of an engine by means of the branched purge passages and at least two electromagnetic valves as compared with the flow rate in the case of using a single electromagnetic valve, thus suppressing the pressure pulsations in the purge passage including the branched purge passages (see Patent Document 1 to Patent Document 6, for example).

Patent Document 1: JP-B6-46017 (P. 3 and FIG. 2)

Patent Document 2: JP-A5-332205 ([0012] and FIG. 2)

Patent Document 3: JP-A6-272582 ([0018] and FIG. 2)

Patent Document 4: JP-A6-272628 ([0017] to [0024] and FIG. 1)

Patent Document 5: JP-A7-83129 ([0012] to [0015] and FIG. 1)

Patent Document 6: JP-A5-10767, a microfilm ([0006] to [0009] and FIG. 1)

At this, FIG. 12 is a chart showing the case where an electromagnetic valve A and an electromagnetic valve B are provided in the respective branched purge passages of a purge passage forked, and control timing of the electromagnetic valve B is controlled with a phase difference of ½ cycles (T/2) relative to that of the electromagnetic valve A.

According to the system, although control frequencies of the electromagnetic valve A and the electromagnetic valve B are as they were, e.g., 10 Hz, they are equivalent, taken the purge passage all together, to the case where the purge passage is controlled in a doubled control frequency, i.e., 20 Hz. Therefore, it can reduce the pressure pulsations in the purge passage without provoking lowering of the electromagnetic valve durability or raising of control resolution due to the increased control frequency.

However, the system shown in FIG. 12 shall produce pressure pulsations in 20 Hz, for example. In the meantime, since there are engines of various specifications, the system shown in FIG. 12 does not always match those engines. On this account, the appearance of a method of reducing the pressure pulsations by various techniques has been earnestly waiting for.

Moreover, in the system shown in FIG. 12, it lacks compactness of the components with the increase of their number as the electromagnetic valve A or the electromagnetic valve B are separately provided in the respective branched purge passages and individually control those electromagnetic valves.

Furthermore, in the technique shown in FIG. 12, while two electromagnetic valves are used and controlled with a phase difference of ½ cycles in order to double an apparent control frequency, a pressure response delay has not been considered at all from the time when an opening or a closing operation of the electromagnetic valve is executed to the time when the operation is reflected upon the response as a pressure fluctuation of the purge passage.

The present invention has been made to solve the above-mentioned problems, and an object of the present invention is to provide a fuel-evaporated gas processing system or an electromagnetic valve device able to efficiently suppress the pressure pulsations in purge gas generated at the time of open and close driving of the electromagnetic valve, repress the degradation of control of an air fuel ratio resulting from the pressure pulsations, or effectually reduce the piping vibrations and pulse sound of the purge passage.

DISCLOSURE OF THE INVENTION

The fuel-evaporated gas processing system according to the present invention takes in evaporated gas evaporated in a fuel tank, temporarily adsorbs the gas in a canister, leads the evaporated gas in the canister to an intake system of an engine, and further includes an input port taking in the evaporated gas from the fuel tank; output ports supplying the evaporated gas taken in through the input port to the intake system of the engine; a chamber interposed between the input port and the output ports; an electromagnetic valve device including at least first and second electromagnetic valves disposed in the connection between the input port or the output ports and the chamber, either of the input port or the output ports being branched off into a plurality of sections, and perform opening and closing operations in response to a driving signal; and a valve control means for driving the first and the second electromagnetic valves of the electromagnetic valve device.

The electromagnetic valve device according to the present invention includes an input port taking in evaporated gas from a fuel tank; output ports supplying the evaporated gas taken in through the input port into an intake system of an engine; a chamber interposed between the input port and the output ports; and at least first and second electromagnetic valves disposed in the connection between the input port or the output ports and the chamber, either of the input port or the output ports being branched off into a plurality of sections, and perform opening and closing operations in response to a driving signal.

According to the fuel-evaporated gas processing system of the present invention, since the first and the second electromagnetic valves are driven, and the pressure pulsations arising from the opening operation or the closing operation of those electromagnetic valves are mixed within the chamber, it enables efficient suppression of the pressure pulsations and efficient reduction of the degradation of the control of an air fuel ratio or the piping vibrations and the pulse sound of the purge passage caused by those pressure pulsations.

According to the electromagnetic valve device of the present invention, the first and second electromagnetic valves and the chamber are integrally combined, which enables the efficient conflation of the pressure pulsations resulting from the opening operation or the closing operation of the first and the second electromagnetic valves in the chamber, and permits the easy securement of an installation space therefor in a downsized engine room.

BEST MODE FOR CARRYING OUT THE INVENTION

Embodiments of the present invention will now be described with reference to the accompanying drawings in order to explain the present invention in more detail.

First Embodiment

Figure 1:
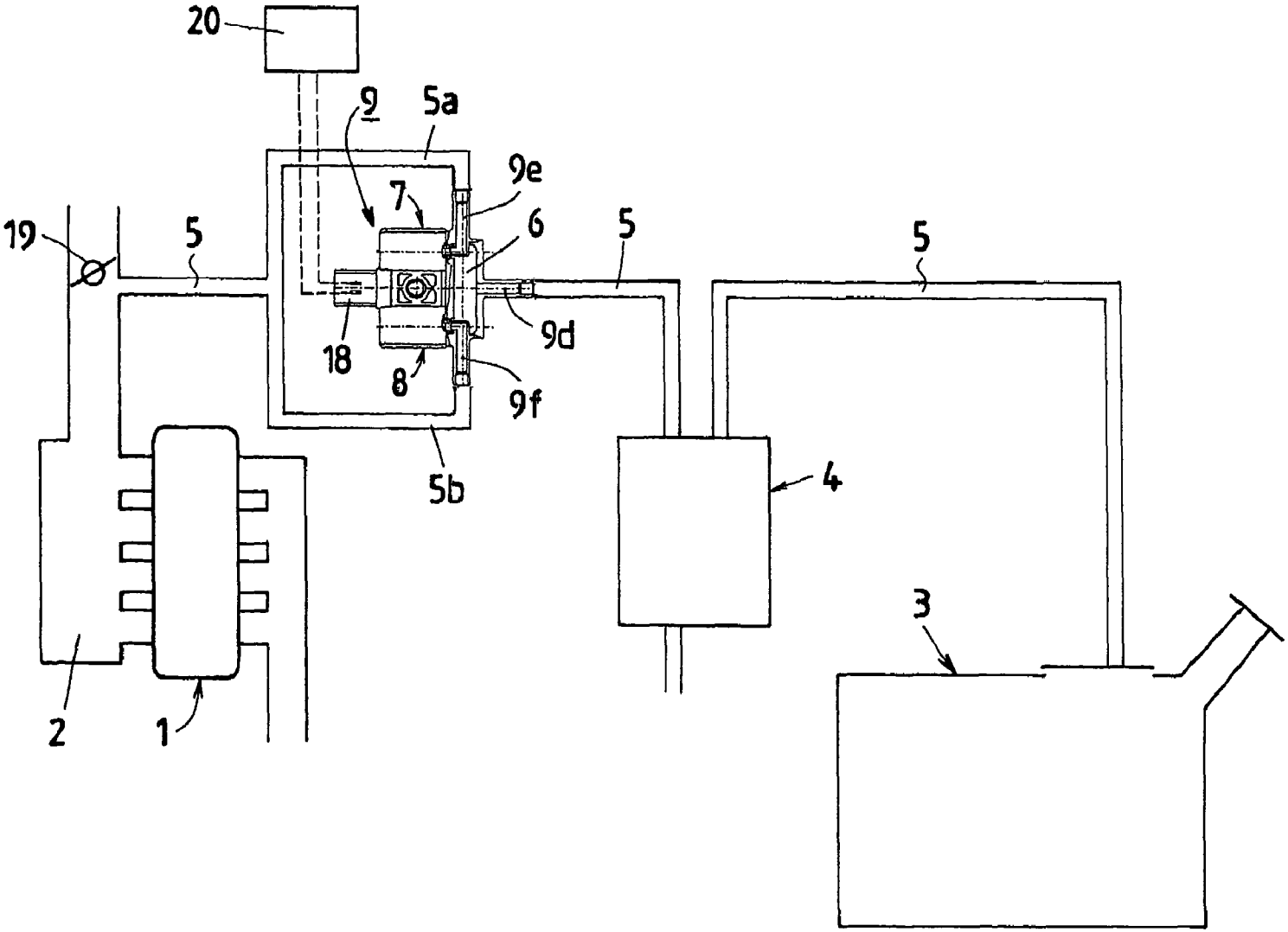
FIG. 1 is a conceptual diagram showing a fuel-evaporated gas processing system according to the first embodiment of the present invention.
Figure 2:
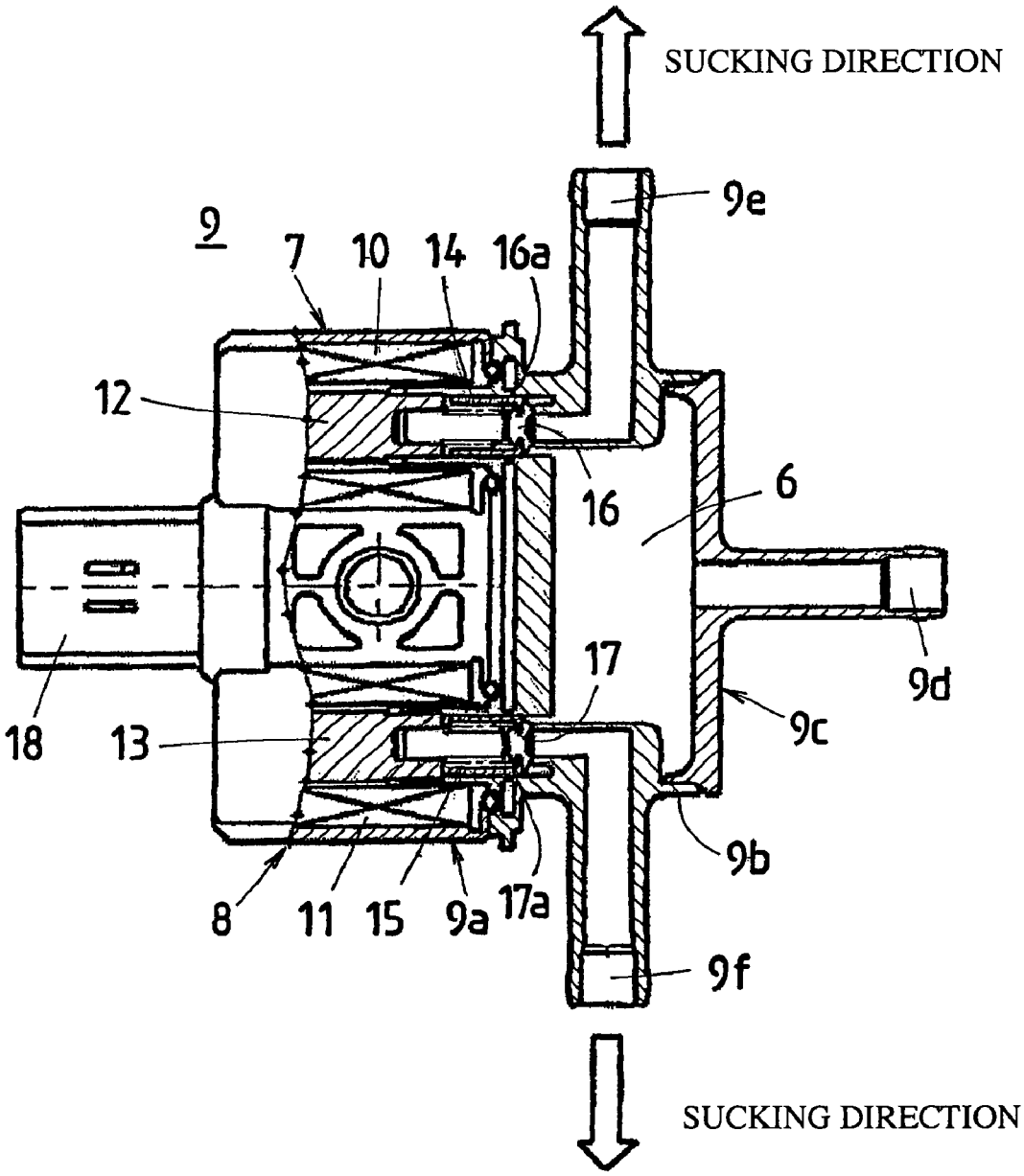
FIG. 2 is an enlarged sectional view showing a valve unit illustrated in FIG. 1.
Figure 3:
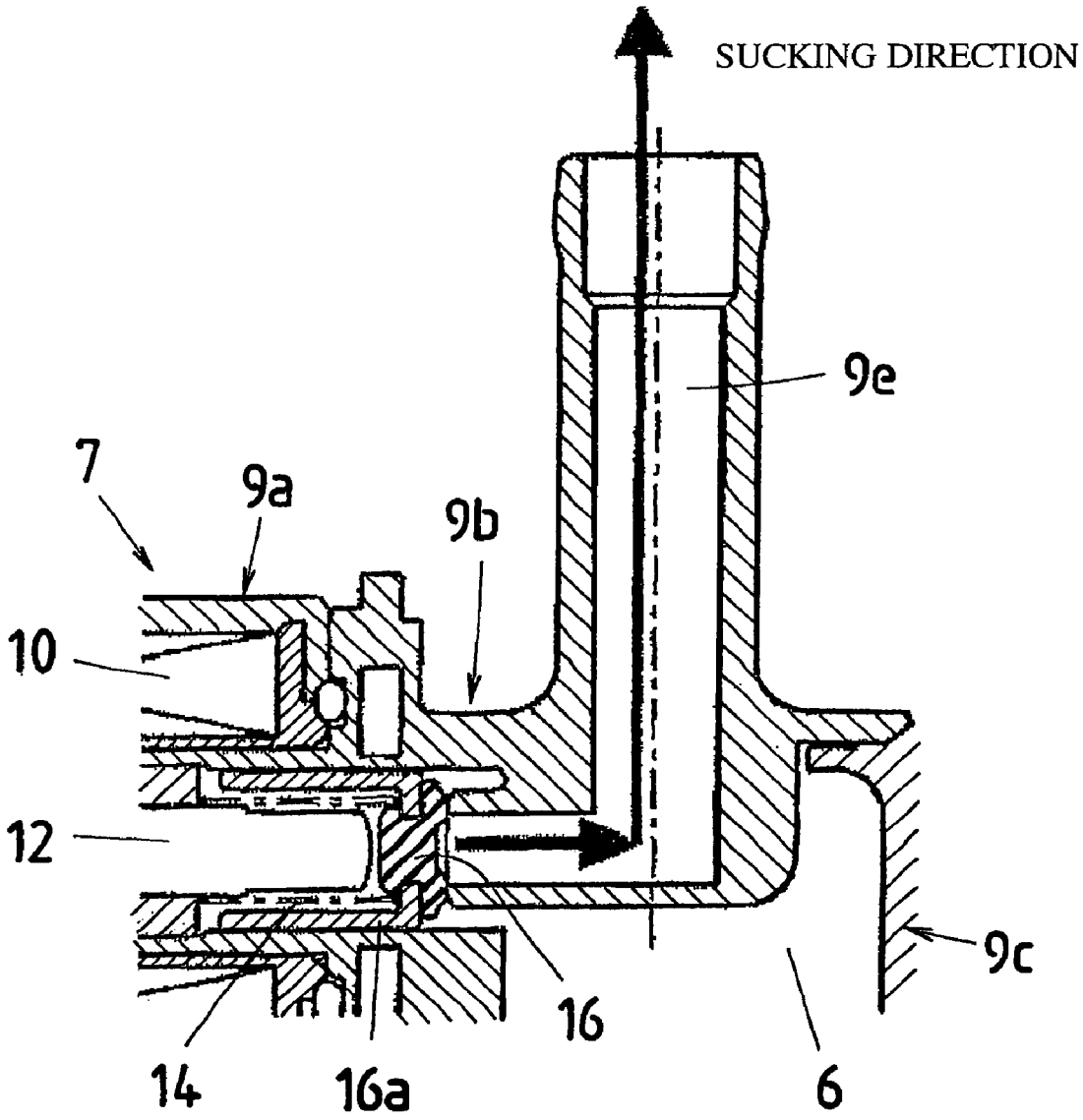
FIG. 3 is an enlarged sectional view showing important points of one of the electromagnetic valve systems of the valve unit illustrated in FIG. 2.

FIG. 1 is a schematic view showing a fuel-evaporated gas processing system according to the first embodiment of the present invention, FIG. 2 is an enlarged sectional view showing a valve unit as the electromagnetic valve device shown in FIG. 1, and FIG. 3 is an enlarged sectional view showing the important points of one of electromagnetic valve systems of the valve unit illustrated in FIG. 2.

As shown in FIG. 1, a purge passage 5 for taking in and processing evaporated gas evaporated within a fuel tank 3 is connected to an intake pipe constituting part of an intake system of an engine 1. A position at which the purge passage is connected to the intake pipe is located in a portion which is situated at downstream from a throttle valve 19 described later and at which negative pressure can be produced. A surge tank 2 is provided at a position located more downstream therefrom. The purge passage 5 is composed of a series of passages such as a passage introducing the evaporated gas generated within the fuel tank 3 into a canister 4, a passage introducing the evaporated gas discharged from the canister 4, which primarily adsorbs the gas with activated carbon into a valve unit 9, and a passage introducing the evaporated gas from the valve unit 9 into the intake pipe.

The valve unit 9 controls the flow rate of purge gas flowing through the purge passage 5, and includes a chamber 6, an electromagnetic valve 7 as a first electromagnetic valve, and an electromagnetic valve 8 as a second electromagnetic valve. The valve unit 9 includes an input port 9*d* described later and output ports 9*e*, 9*f*, branched off into two directions. Further, the input port 9*d* is connected with the purge passage 5 connecting the canister 4 and the valve unit 9. Moreover, the output ports 9*e*, 9*f* are connected with purge passages 5*a*, 5*b*, respectively, which are two branched purge passages. The two divided purge passages 5*a*, 5*b* merge into one purge passage at downstream thereof, and the resultant purge passage is connected to the intake pipe.

Referring to FIG. 2, reference numeral 9*a* denotes a housing to house the electromagnetic valves 7, 8, reference numeral 9*b* denotes a housing forming the output ports branched off into two directions, reference numeral 9*c* denotes a cap member as a cap section welded to the housing 9*b*, and the cap member 9*c* includes the chamber 6 together with the housing 9*a* or the housing 9*b*. Here, the housing 9*a* and the housing 9*b* may be an integrally combined one, or separated ones. Reference numeral 9*d* denotes the input port formed in the cap member 9*c*. Solenoid coils 10, 11 are solenoid coils of the electromagnetic valve 7 and the electromagnetic valve 8 included in the housing 9*a*, and those solenoid coils 10, 11 individually surround cores 12, 13, thus generating magnetic fields in the cores 12, 13.

The respective one ends of those cores 12, 13 are provided with plungers (valving element) 16, 17, which are coaxially disposed movably in an axial direction through springs 14, 15, and individually open and close the branched purge passages 5*a*, 5*b* in the chamber 6. Besides, the respective solenoid coils 10, 11 are provided with a connector 18 to which a voltage signal (duty control signal) is input and a valve control means 20 generating the voltage signal. Hereupon, the valve control means 20 may be made of an engine control unit (ECU), performing the ignition system control or the fuel system control such as the control of an air fuel ratio etc, of the engine 1, or may be made of a dedicated valve control unit.

FIG. 3 shows the state where the electromagnetic valve 7 is closed. In the first embodiment, the purge passage is connected to the downstream of the throttle valve 19. For this reason, when the engine 1 is in action, negative pressure is produced in the downstream of the throttle valve 19. The negative pressure is introduced into the output port 9*e* or 9*f* through the purge passage 5.

Otherwise, one end of the output port 9*e* or 9*f* is opened to the chamber 6, opposed to the plunger 16 or 17, and its opening is opened and closed by the plunger 16 or 17 driven in response to the duty control signal from the valve control means 20.

Therefore, in the first embodiment, as indicated by an arrow in FIG. 3, the two electromagnetic valves 7, 8 are arranged to receive suction force generated when the engine 1 is at work, in a closing direction of the valve, and this arrangement is called as a forward suction type arrangement. Say in addition, the plungers 16, 17 have urging force exerted by the springs 14, 15 disposed in the ends of the cores 12, 13, and ensure a sealing performance of the closed valve while the voltage signal is cut off by the urging force.

The operation thereof will now be described below.

In the state where the engine 1 is driven, the purge gas adsorbed in the canister 4 is supplied to the intake pipe of the engine, and the gas is burnt by the engine 1. The duty control signal is fed to the connector 18 of the valve unit 9 from the valve control means 20, thus driving the electromagnetic valves 7, 8.

Figure 12:
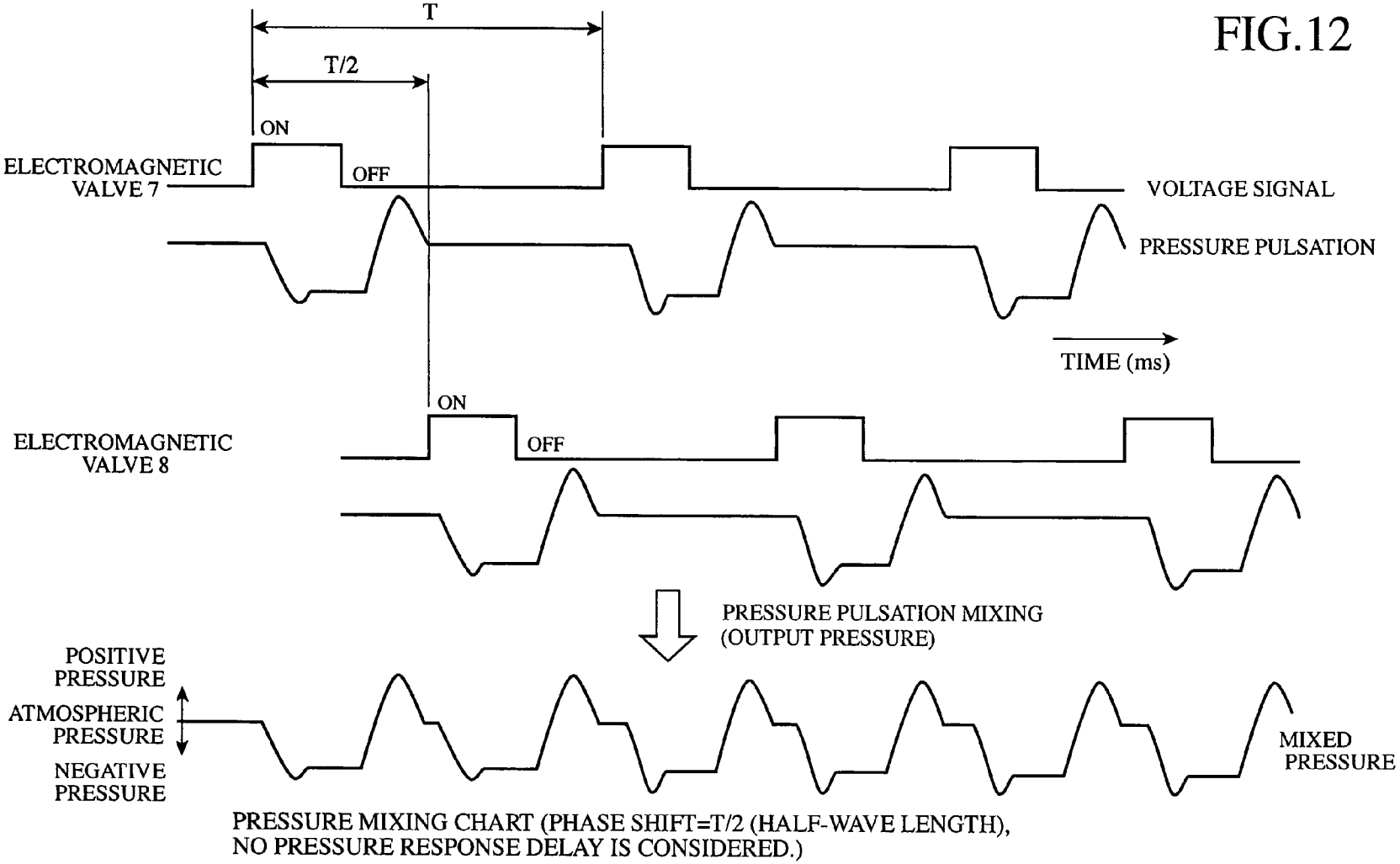
FIG. 12 is a chart showing operation timing of two electromagnetic valves of a conventional system in connection with pressure pulsations.

Hereupon, when the electromagnetic valve is executed a closing operation causing the valve in the opened state to transfer to the closed state or an opening operation causing the valve in the closed state to transfer to the opened state, pressure fluctuations are caused. The pressure fluctuations appear not immediately after an issuance of a command for opening or closing the valve but emerge with a predetermined response delay. In the conventional example explained in FIG. 12 described above, two electromagnetic valves are driven simply with a phase difference of ½ cycles therebetween, thereby apparently doubling a duty control frequency, making the basis, of 10 Hz, e.g., to 20 Hz. At this point, no regard is paid to the response delay occurred in the pressure fluctuations.

Upon this, in the first embodiment, when canceling the pressure fluctuations caused by the valve opening operation or the valve closing operation of the electromagnetic valve 7 by firstly driving the electromagnetic valve 7 as the first electromagnetic valve and then by driving the electromagnetic valve 8 as the second electromagnetic valve, the electromagnetic valve 8 is driven in expectation of the above-mentioned predetermined response delay.

Figure 4:
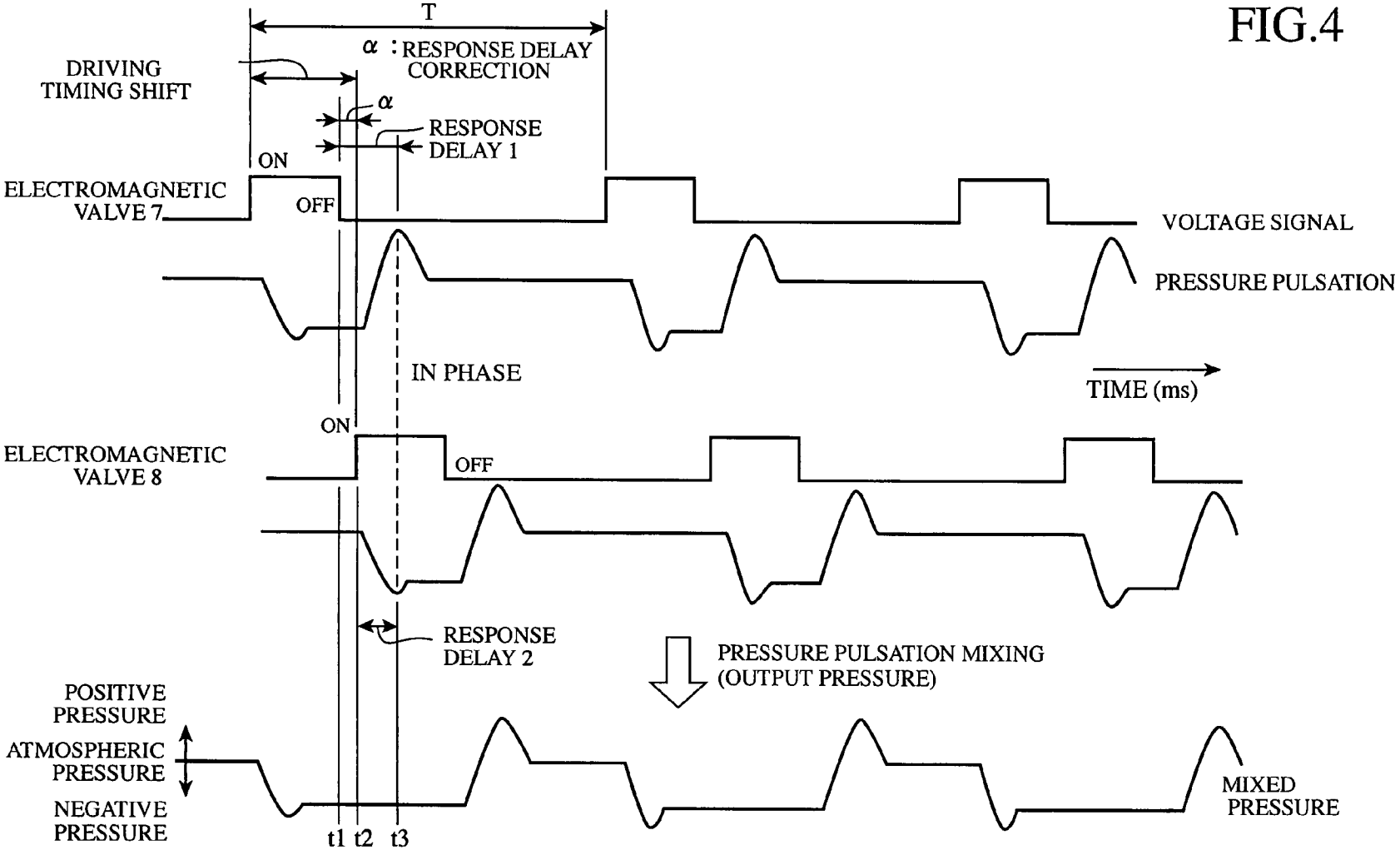
FIG. 4 is a chart showing operation timing of the two electromagnetic valves in connection with pressure pulsations.

FIG. 4 is a chart showing operation timing of the two electromagnetic valves according to the first embodiment in connection with pressure pulsations. It should be noted that in the first embodiment, the electromagnetic valve 7 and the electromagnetic valve 8 have almost the same flow rate characteristic. The flow rate characteristic came out here is shown by characteristics represented in two-dimensional coordinates in which one is taken as the duty ratio and the other is taken as the flow rate, and is like that shown in FIG. 8 described later, for example.

At the time t1 in FIG. 4, the valve control means 20 gives a command signal for performing a valve closing operation to the electromagnetic valve 7. Receiving the signal, the valve 7 transfers to the valve closed state from the valve opened state; however, the pressure fluctuations of the purge passage 5 occur behind the command signal and show waveform having a peak at the time t3. In other words, there is a response delay 1 in the pressure fluctuations from the time t1 to the time t3 at the time of valve closing operation of the electromagnetic valve 7. On that account, the valve control means 20 gives a command signal for performing the valve opening operation to the valve 8 in contrast with the closing operation of the electromagnetic valve 7. Receiving the signal, the electromagnetic valve 8 transfers to the valve opened state from the valve closed state; however, the pressure fluctuations of the purge passage 5 show waveform having a peak behind the operation. Referring to FIG. 4, in the valve opening operation of the electromagnetic valve 8, there is a response delay 2 in the pressure fluctuations from the time t2 to the time t3.

Therefore, the valve control means 20 controls the electromagnetic valve 8 with a predetermined response delay correction value a such that the peak of the pressure fluctuations resulting from the valve opening operation of the electromagnetic valve 8 coincides with those arising from the valve closing operation of the electromagnetic valve 7 at the time t3 where the peak thereof occurs, caused by the valve closing operation of the electromagnetic valve 7.

In this connection, the response delay 1 and the response delay 2 are not necessarily of the same value. Furthermore, the individual response delay 1 and response delay 2 slightly vary depending on the electromagnetic valve device and the duty ratio used. Therefore, it may measure in advance the response delay according to duty ratio, and control the processing system by using the value in the valve control means.

According to the first embodiment shown in FIG. 4, the peak of the pressure fluctuations spring from the valve closing operation of the electromagnetic valve 7 and those arising from the valve opening operation of the electromagnetic valve 8 are coincided with each other, thus canceling the pressure fluctuations. It should be understood that the response delay of the pressure fluctuations are canceled in anticipation of the delays therein, which actually occur in the purge passage. This enables effectual cancellation of the pressure fluctuations.

Besides, in the first embodiment, the pressure fluctuations attributable to the valve closing operation of the electromagnetic valve 7 and those ascribed to the valve opening operation of the electromagnetic valve 8 are positively used to cancel each other. On this account, it is desirable that the place where those two pressures fluctuations are mixed with each other be set so as to be near to the electromagnetic valve 7 and the electromagnetic valve 8. Accordingly, in the valve unit 9 of the first embodiment, the electromagnetic valve 7, the electromagnetic valve 8, and the chamber 6 are integrally combined to cancel the pressure fluctuations in the chamber 6.

Figure 5:
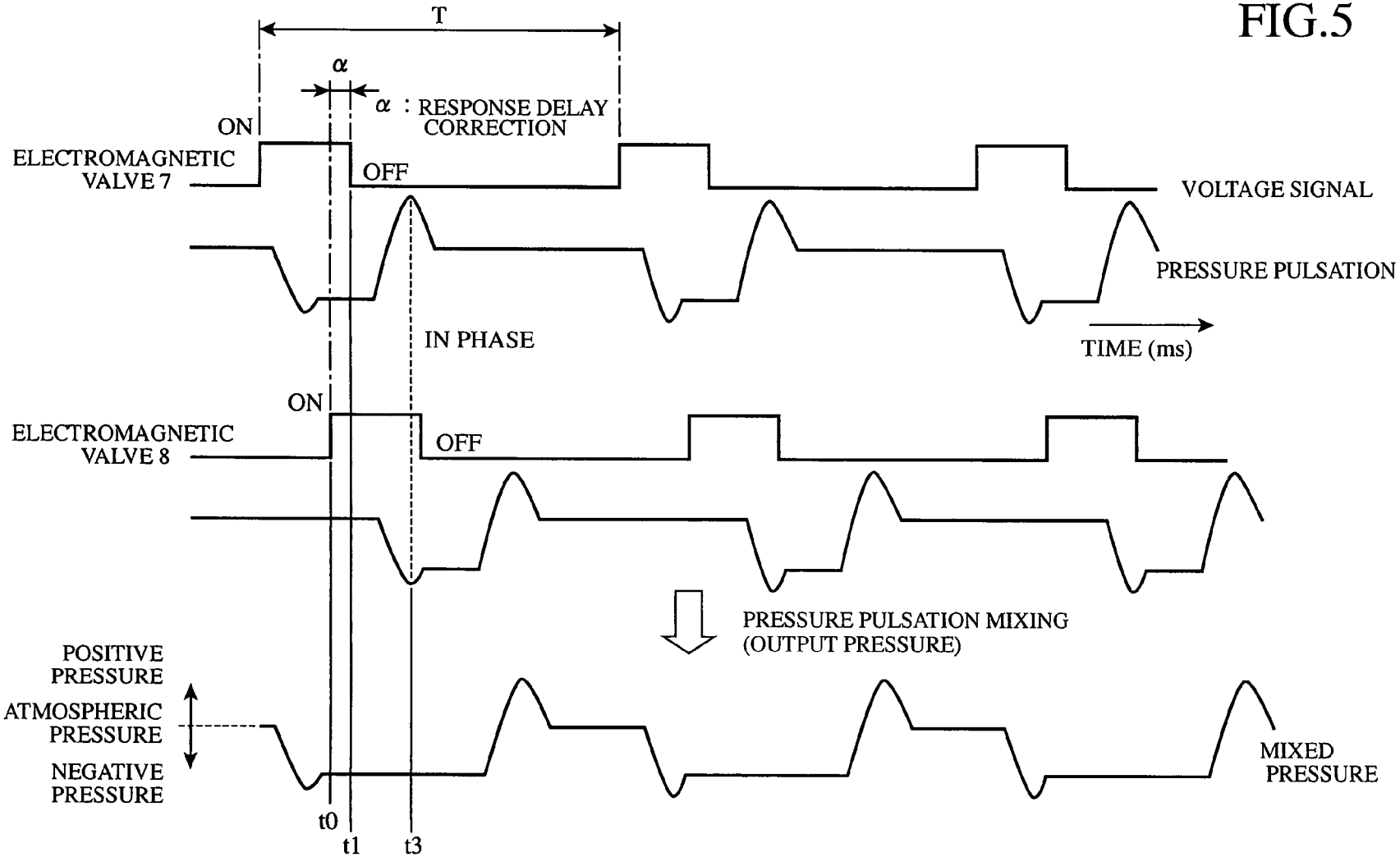
FIG. 5 is a chart showing operation timing of the two electromagnetic valves in connection with pressure pulsations.

Upon this, in FIG. 4, the command signal for the valve opening operation of the electromagnetic valve 8 is given after the issuance of the command signal for the valve closing operation of the electromagnetic valve 7. However, if the response delay 2 to the valve opening operation of the electromagnetic valve 8 is long, the command signal for the valve opening operation of the electromagnetic valve 8 should be given, in some cases, before the issuance of the command signal for the valve closing operation of the electromagnetic valve 7 in order to bring the peak of the pressure fluctuations caused by the valve closing operation of the electromagnetic valve 7 and those due to the valve opening operation of the electromagnetic valve 8 into agreement with each other. FIG. 5 is a chart showing operation timing of the two electromagnetic valves in connection with the pressure pulsations.

While the operations illustrated in FIG. 5 are basically the same as those shown in FIG. 4, they are different from each other in that the command signal for the valve opening operation of the electromagnetic valve 8 is given at the time t0 by adding the response delay correction value α.

Figure 6:
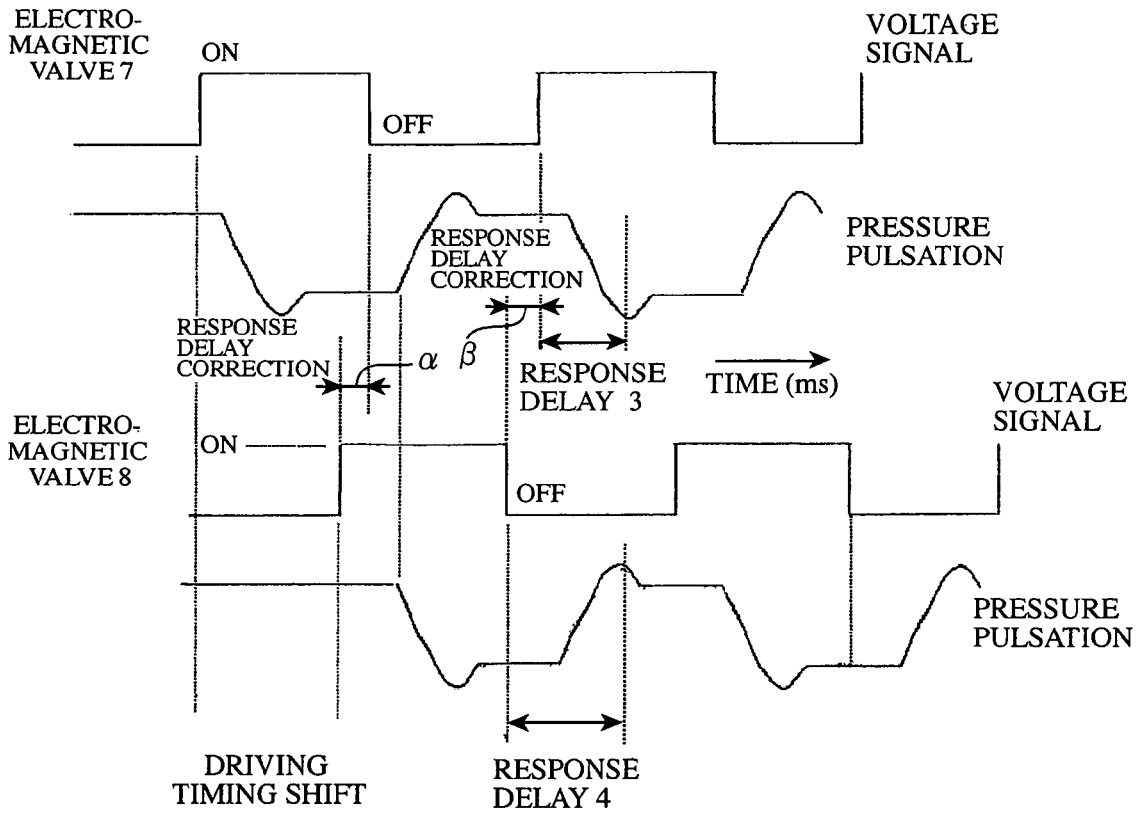
FIG. 6 is a chart diagram showing operation timing of the two electromagnetic valves in connection with pressure pulsations.

FIG. 6 is an example where the duty control ratio in the chart shown in FIG. 5 is reduced to 50%. The chart shown in FIG. 5 is for canceling the pressure fluctuations arising from the valve closing operation of the electromagnetic valve 7 in response to those originating from the valve opening operation of the electromagnetic valve 8. For this reason, the pressure fluctuations caused by the valve opening operation of the electromagnetic valve 7 and those due to the valve closing operation of the electromagnetic valve 8 are not canceled, and those fluctuations occurred therein generate pressure pulsations of a basic duty control frequency of 10 Hz, for example. However, if the duty control ratio is 50%, since the peak of the pressure fluctuations resulting from the valve opening operation of the electromagnetic valve 7 and those arising from the valve closing operation of the electromagnetic valve 8 are relatively near to each other, those pressure fluctuations are canceled by adjusting the control timing of the electromagnetic valve 7 or the electromagnetic valve 8, thus enabling cancellation of the pressure fluctuations, resulting from all the valve opening and the valve closing operations of the electromagnetic valve 7 and the valve opening and the valve closing operations of the electromagnetic valve 8.

Say in addition, in FIG. 4 or FIG. 5, the example is taken where the pressure fluctuations caused by the valve closing operation of the electromagnetic valve 7 is canceled by those due to the valve opening operation of the electromagnetic valve 8. However, not limited thereto, the pressure fluctuations spring from the valve opening operation of the electromagnetic valve 7 may be canceled, instead thereof, by those arising from the valve closing operation of the electromagnetic valve 8.

Also, as with the case described above, if the duty control ratio is 50%, the pressure fluctuations arising from the valve closing operation of the electromagnetic valve 7 can be canceled by those spring from the valve opening operation of the electromagnetic valve 8.

As described above, according to the first embodiment, the two electromagnetic valves 7, 8 are operated with the driving timing of the electromagnetic valve 7 staggered by the response delay, thus canceling the pressure fluctuations occurred at the driving time, and enabling thereby stabilization of the pressure pulsations of the purge gas flowing through the purge passage 5. This allows efficient reduction of the degradation of the control of air fuel ratio or the effectual diminish of the piping vibrations and the pulse sound of the purge passage 5 caused by the abrupt pressure pulsations.

Whereupon, in the first embodiment, it is arranged such that the output ports of the valve unit 9 be branched off into the output ports 9*e*, 9*f*, those output ports be connected to the purge passages 5*a*, 5*b*, respectively, and the purge passages 5*a*, 5*b* merge into one passage on the intake pipe side located at its downstream.

Figure 7:
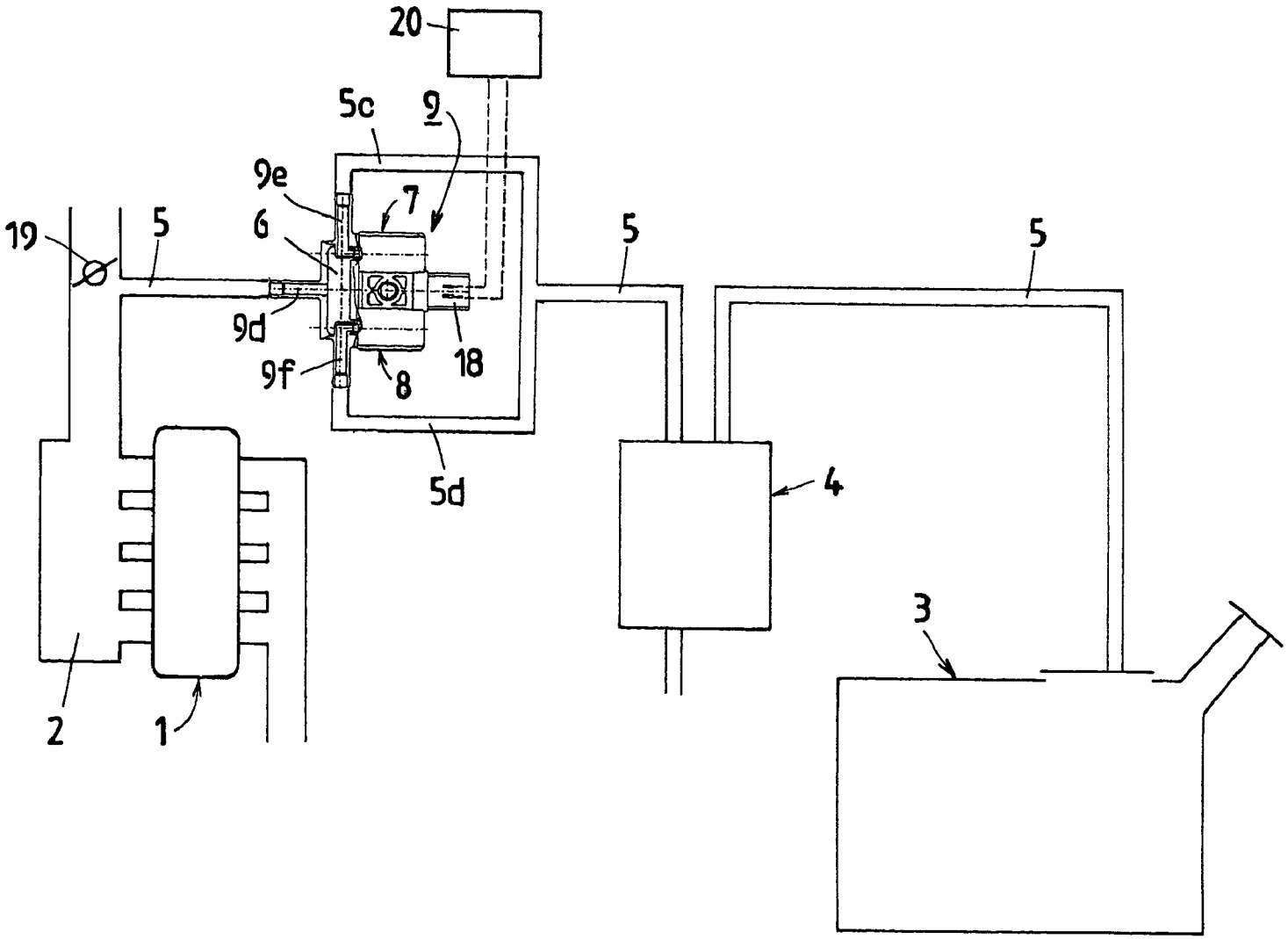
FIG. 7 is a conceptual diagram showing a modification of the fuel-evaporated gas processing system.

However, not limited thereto, it does without saying that the processing system may be configured as shown in FIG. 7. FIG. 7 is a conceptual diagram showing the fuel-evaporated gas processing system. In FIG. 7, the purge passage 5 extending from the canister 4 to the valve unit 9 is branched off into purge passages 5*c*, 5*d*, and those respective purge passages are connected to a plurality of input ports provided within the valve unit 9. The plurality of input ports are open and close controlled by means of the electromagnetic valves individually provided therein. The pressure fluctuations arising from the open and close control are mixed with each other, and are canceled within the chamber 6 between the input port and the output ports. The chamber 6 communicates with the output ports, and the output ports are connected to the downstream of the throttle valve 19 of the intake pipe by the purge passage 5. In FIG. 7, the purge passage 5 connecting the output ports and the intake pipe are made of a single piping.

Parenthetically, in the first embodiment, the example is given where the single electromagnetic valve 7 as the first electromagnetic valve, and the single electromagnetic valve 8 as the second electromagnetic valve are used.

However, each of the first electromagnetic valve and the second electromagnetic valve does not have to be made of a single electromagnetic valve, and may compose of a plurality of electromagnetic valves. For example, in order to increase the maximum flow rate of the purge passage, it may be arranged that two electromagnetic valves 7 as the first electromagnetic valve and two electromagnetic valves 8 as the second electromagnetic valve be provided, and four branched passages be used conforming to those valves.

Second Embodiment

In the first embodiment, the example is given where the electromagnetic valve 7 and the electromagnetic valve 8 having almost the same flow rate characteristic are used. However, combining the electromagnetic valves having a different characteristic enables achieving the required flow rate characteristic. In the second embodiment, an example will be explained where electromagnetic valves having a different flow rate characteristic are used.

Figure 8:
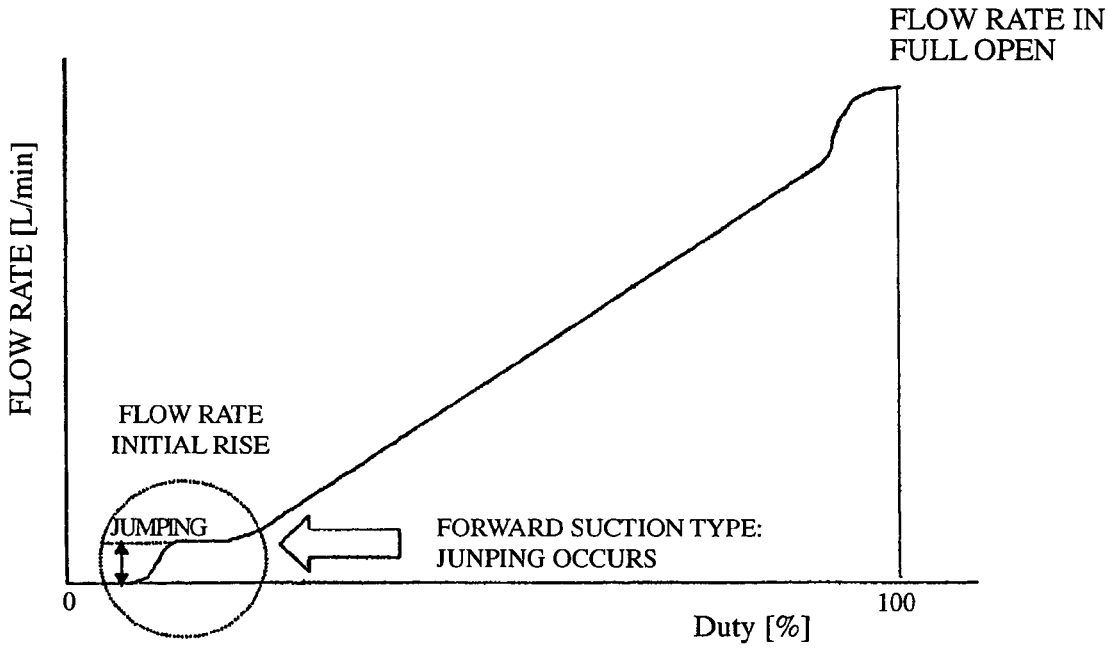
FIG. 8 is a diagram of a flow rate characteristic of the electromagnetic valve of the forward suction type at the time of an opening operation.
Figure 9:
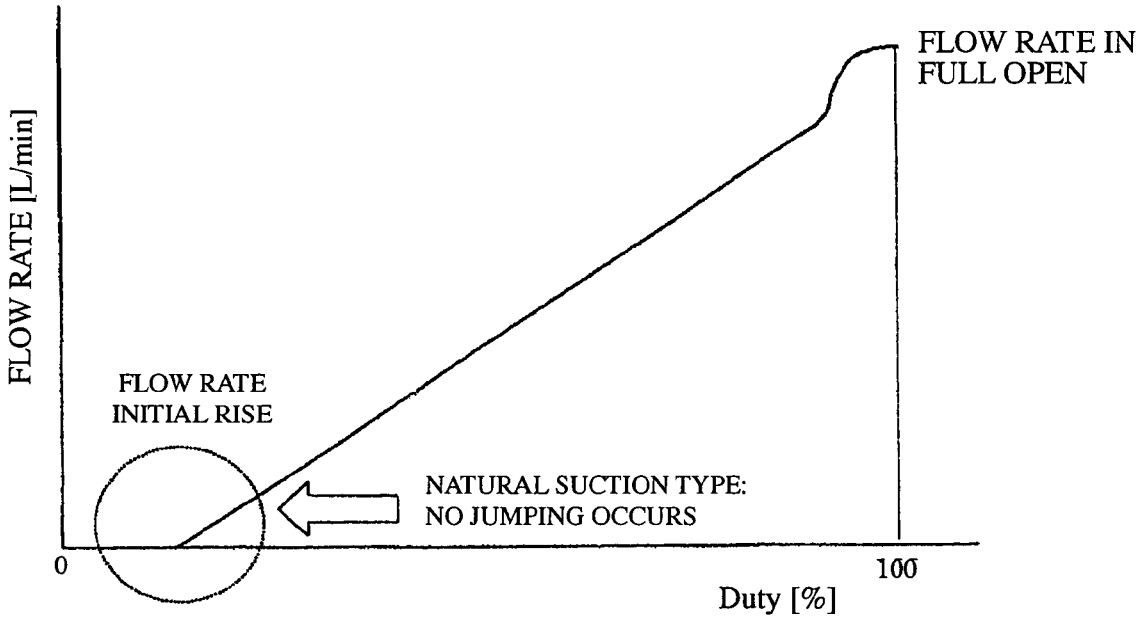
FIG. 9 is flow rate characteristics of the electromagnetic valve of the reverse suction type at the time of an opening operation.

FIG. 8 shows a flow rate characteristic of the electromagnetic valve of the forward suction type where negative pressure acts in a valve closing direction, represented in coordinates in which the duty ratio is taken as a horizontal axis and the flow rate is taken as a vertical direction with respect to each duty ratio. The electromagnetic valves 7, 8 used in the first embodiment are electromagnetic valves of the forward suction type having a flow rate characteristic like that shown in FIG. 8. FIG. 9 shows a flow rate characteristic of the electromagnetic valve of the reverse suction type where negative pressure acts in a valve opening direction, represented in coordinates in which the duty ratio at the time of opening operation is taken as a horizontal axis and the flow rate relative to each duty ratio is taken as a vertical axis.

Figure 10:
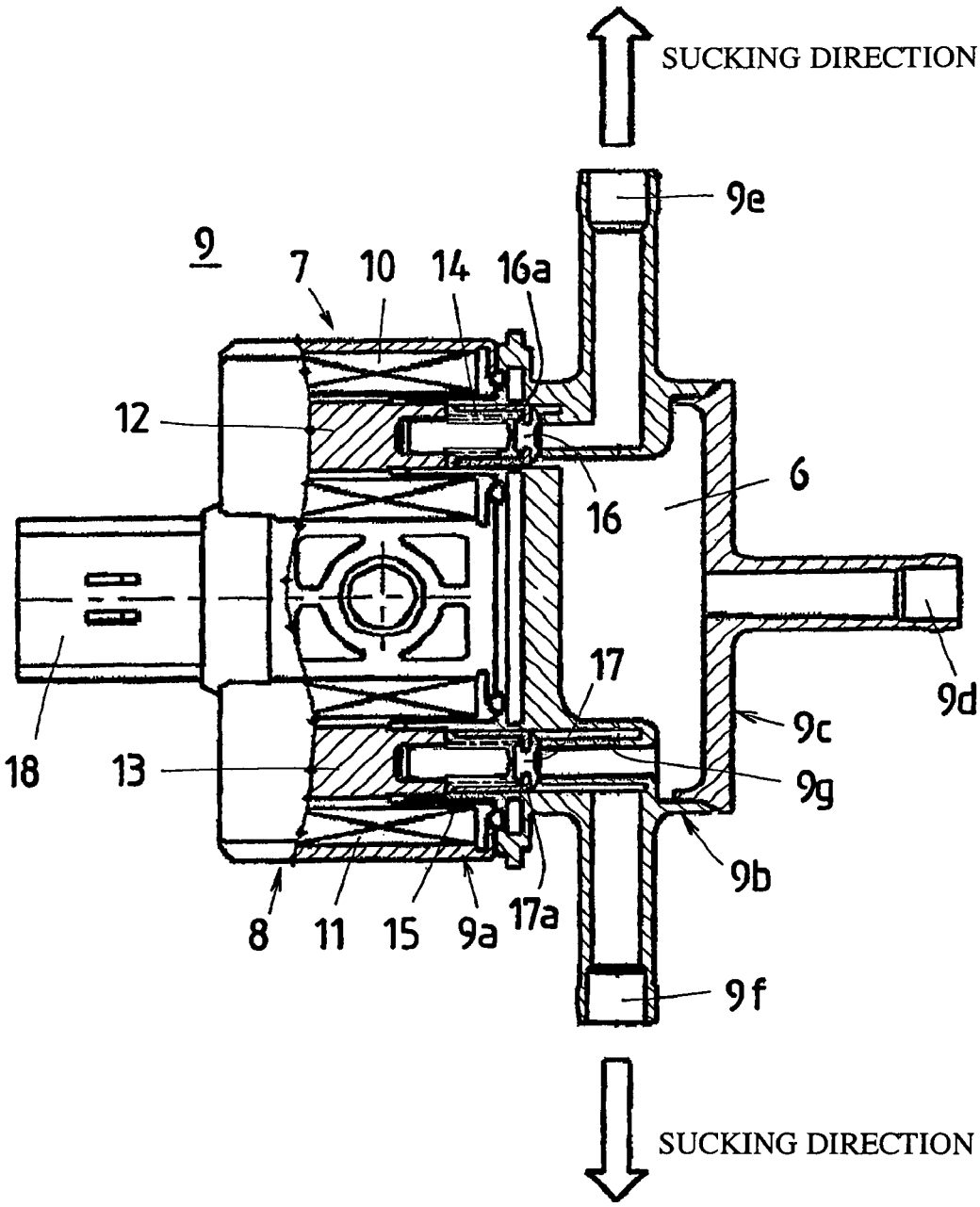
FIG. 10 is an enlarged sectional view showing a valve unit according to the second embodiment of the present invention.
Figure 11:
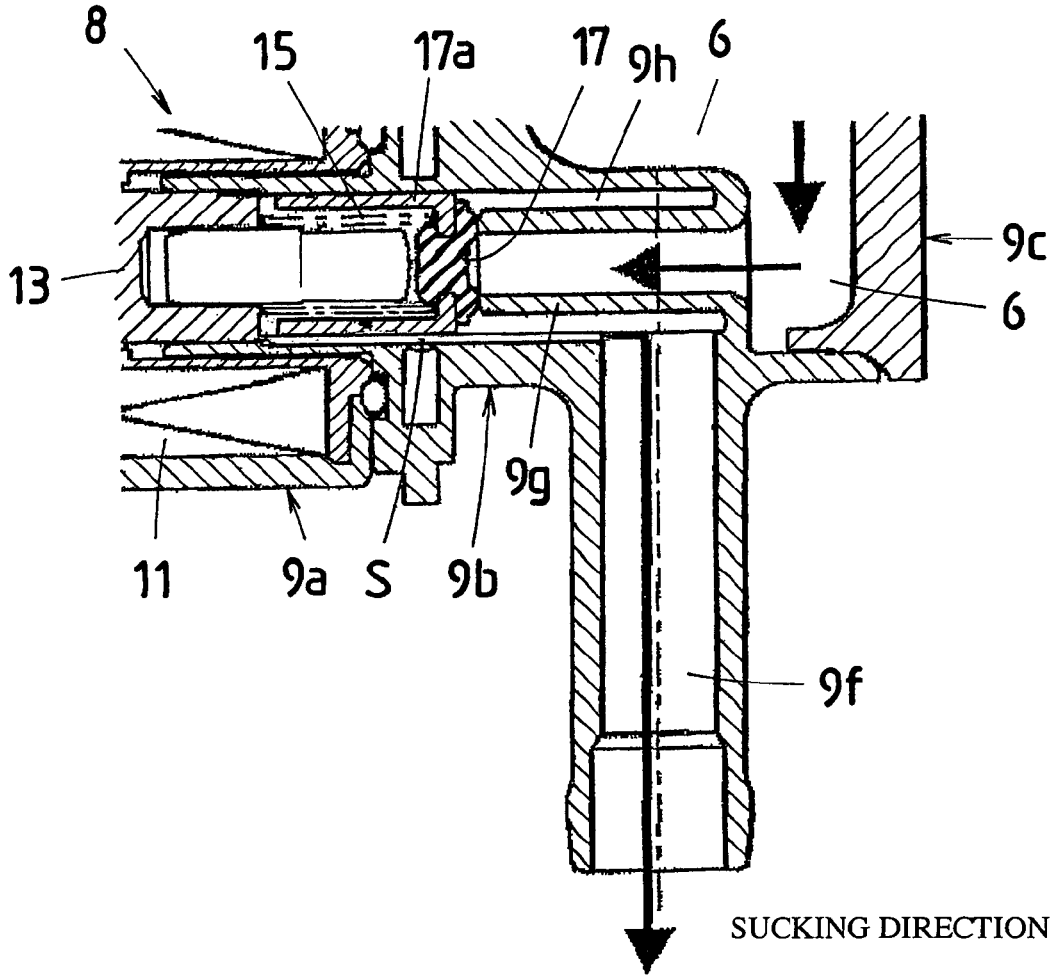
FIG. 11 is an enlarged sectional view showing important points of a reverse-suction electromagnetic valve system of the valve unit.

FIG. 10 is an enlarged sectional view showing a valve unit 9 according to the second embodiment in which, of two electromagnetic valves 7, 8, the electromagnetic valve 7 is taken as the electromagnetic valve of the forward suction type, and the electromagnetic valve 8 is taken as the electromagnetic valve of the reverse suction type. Here, the electromagnetic valve 7 constitutes the first electromagnetic valve, and the electromagnetic valve 8 constitutes the second electromagnetic valve. FIG. 11 is an enlarged sectional view showing the important points of the electromagnetic valve system of the reverse suction type of the valve unit 9 shown in FIG. 10.

In FIG. 11, the electromagnetic valve 8 of the reverse suction type is arranged such that suction force of the negative pressure produced when the engine is in action acts on the backside of the plunger 17 within the electromagnetic valve 8 by integrally forming an inner cylindrical valve-hole cylinder 9*g* with the housing 9*a* of the valve unit 9 as a suction path at a position opposed to the plunger 17 of the electromagnetic valve 8 within the chamber 6; by forming a suction path 9*h* around the periphery of the valve-hole cylinder 9*g*; and by communicating the suction path 9*h* with the inside of the plunger 17 through a clearance S of the plunger 17.

The arrangement of the fuel-evaporated gas processing system according to the second embodiment is able to achieve characteristics meeting the requirements by switching electromagnetic valves to be driven or simultaneously driving the valves according to the required characteristics.

For example, in the case of the electromagnetic valve of the forward suction type used in the first embodiment, as shown the flow rate characteristic thereof in FIG. 8, a phenomenon, called as jumping occurs, which behaves that the flow rate rapidly rises at the time of valve opening in a low flow rate area. The phenomenon becomes an issue particularly at the idling time etc. At the idling time, the amount of air supplied to the engine 1 and the amount of fuel injection are small, and further, delicate control is executed. At that time, the amount of the purge supplied through the purge passage 5 is also small. However, in that case, when the jumping shown in FIG. 8 is occurred, the amount of the purge gas steeply increases, resulting in the temporarily excessive amount of the fuel being supplied to the engine 1. At the idling time, only a small amount of fuel air mixtures is supplied to the engine 1, and therefore abruptly increased purge gas becomes a chief factor of degrading the control of the air fuel ratio, being influenced thereby, even in a small amount. Moreover, the resultant variations of the air fuel ratio lead to fluctuations of the rotation speed in idling.

Thus, in the second embodiment, the ingenuity is exerted that the electromagnetic valve 8 is replaced with the valve of the reverse suction type free from jumping shown in FIG. 9, and the reverse suction type is driven in the low flow rate area.

To say more precisely, when the flow rate of the purge gas is low, only the electromagnetic valve 8 of the reverse suction type is driven, which attains a highly accurate control performance free from jumping. However, since the electromagnetic valve 7 is not driven on this occasion, the pressure fluctuations cannot be canceled necessarily. However, when the flow rate of the purge gas is low, the pressure fluctuations are small, and hence a great problem does not arise even by not proactively canceling the fluctuations. In this context, in the electromagnetic valve of the forward suction type, jumping occurs only in the duty ratio of from 0% to 10% or 20%.

Therefore, it is preferable that in the low flow rate area where the duty ratio is up to about 20% or less, only the electromagnetic valve 8 of the reverse suction type be driven, and in the area where the duty ratio is 20% or more, at which jumping hardly occurs, both the electromagnetic valve 7 of the forward suction type and the electromagnetic valve 8 of the reverse suction type 8 be driven, thereby controlling the processing system in such a manner as to cancel the pressure fluctuations caused by the valve opening operation or the valve closing operation, as explained in the above-mentioned embodiment.

As described above, according to the second embodiment, in the low flow rate area where jumping may occur, only the electromagnetic valve of the reverse suction type is driven, and in the flow rate area where the flow rate is larger than that in the low flow rate area, where jumping scarcely occurs, both the electromagnetic valve of the forward suction type and the electromagnetic valve of the reverse suction type are driven, which enables high accurate control in the low flow rate area, and the suppressed pressure fluctuations in the all flow rate areas.

Remark parenthetically, in the second embodiment, the example is given in which the single electromagnetic valve 7 as the first electromagnetic valve and the single electromagnetic valve 8 as the second electromagnetic valve are used.

However, each of the first electromagnetic valve and the second electromagnetic valve does not have to be made of a single one, and alternatively may be composed of a plurality of electromagnetic valves.

Third Embodiment

In the second embodiment, the ingenuity is racked that in the low flow rate area where jumping may occur, only the electromagnetic valve 8 of the reverse suction type is driven, and in the flow rate area where the rate is larger than that in the low flow rate area, in which jumping hardly occurs, both the electromagnetic valve 7 of the forward suction type and the electromagnetic valve 8 of the reverse suction type are driven. In the second embodiment, the same maximum flow rate is used in the electromagnetic valve 7 and the electromagnetic valve 8.

In contrast thereto, in the third embodiment, the electromagnetic valve 8 of the reverse suction type has the maximum flow rate smaller than that of the electromagnetic valve 7 of the forward suction type.

For example, when the flow rate accomplished when both the electromagnetic valve 7 and the electromagnetic valve 8 are driven at a duty ratio of 100% is assumed to be the maximum flow rate of the purge passage, the electromagnetic valve 8 is selected, of which maximum flow rate is less than 50% of the maximum flow rate of the purge passage, and the electromagnetic valve 7 is selected, of which maximum flow rate is equal to or more than 50% of the maximum flow rate of the purge passage.

In that event, according to the third embodiment, since the maximum flow rate of the electromagnetic valve 8 of the reverse suction type is set so as to be small, the control resolution of the electromagnetic valve can be improved. Moreover, driving both the electromagnetic valve 7 and the electromagnetic valve 8 cancellation of those fluctuations is realized by making use of the pressure fluctuations occurred in those valves.

It should be noted that what maximum flow rate should be selected for the electromagnetic valve 7 as the first electromagnetic valve and the electromagnetic valve 8 as the second electromagnetic valve exclusively depends on the balance of the improvement of the control resolution in the low flow rate area by the electromagnetic valve 8 and an effect of canceling the pressure fluctuations by the electromagnetic valves 7, 8.

Parenthetically, in the third embodiment, the example is taken where the single electromagnetic valve 7 as the first electromagnetic valve and the single electromagnetic valve 8 as the second electromagnetic valve are used for each.

However, the first electromagnetic valve or the second electromagnetic valve each does not mutually have to be made of a single electromagnetic valve, and alternatively may be composed of a plurality of electromagnetic valves.

For example, it may be arranged that a single electromagnetic valve having the maximum flow rate, which is about 20% of the maximum flow rate of the purge passage, be selected as the electromagnetic valve of the reverse suction type, and the remaining 80% be respectively covered by the electromagnetic valves of the forward suction type by 40% for each.

As a control method at this time, e.g., in the low flow rate area where the flow rate is less than 20% and jumping is apt to occur, only the electromagnetic valve of the reverse suction type is driven. Then, in the flow rate area of 20% or more, the electromagnetic valve of the reverse suction type is stopped its driving to cancel the mutual pressure fluctuations with the two electromagnetic valves of the forward suction type. When the flow rate is further increased to attain the flow rate of 80% or more, it may be arranged that the electromagnetic valve of the reverse suction type be driven, and the flow rate unattainable by the electromagnetic valve of the reverse suction type be bore the burden fifty-fifty by the two remaining electromagnetic valves of the forward suction type.

On this occasion, the driving timing of the electromagnetic valve of the reverse suction type may be driven in synchronization with either of the electromagnetic valves of the forward suction type, or the electromagnetic valve may be driven with the driving timing different from that of both the electromagnetic valves. Alternatively, according to the flow rate, at one time, the electromagnetic valve may be driven in synchronization with one of the electromagnetic valves of the forward suction type, and at another time, the valve may be driven in synchronization with the other electromagnetic valve of the forward suction type.

As mentioned above, in the processing system with a plurality of electromagnetic valves, various control methods can be considered, which make possible to provide control highly rich in variations.

It should be noted that the examples of the above-mentioned control methods and the description of what maximum flow rate that the electromagnetic valves may take should be used are given merely by way of examples, and so various modifications may be possible.

In consequence, according to the above-mentioned control, the flow rate up to 20%, high accurate control is feasible by the electromagnetic valve of the reverse suction type, and further, in the flow rate area of 20% or more, a desired flow rate can be attained and the pressure fluctuations can be canceled by driving the two remaining electromagnetic valves of the forward suction type.

Fourth Embodiment

Hereupon, while in the second and third embodiments, the example is given where different type electromagnetic valves are used in order to prevent the occurrence of jumping, different ones do not always have to be used.

For example, the flow rate achieved when both the electromagnetic valve 7 and the electromagnetic valve 8 are driven at a duty ratio of 106% is assumed to be the maximum flow rate of the purge passage, the electromagnetic valve 8 having the maximum flow rate less than 50% of the maximum flow rate of the purge passage is selected, and the electromagnetic valve 7 having the maximum flow rate more than 50% of the maximum flow rate of the purge passage is selected.

The combination of the electromagnetic valve 7 and the electromagnetic valve 8 at that time has the freedom in which both of the electromagnetic valves may be the reverse suction type, or the forward suction type. It should be noted that if the reverse suction type are selected for both the electromagnetic valves, the enhanced control accuracy in the low flow rate area and the suppressed pressure fluctuations in the flow rate area more than the above flow rate can be simultaneously actualized, as jumping does not occur in the low flow rate area.

Otherwise, a case will be described where the forward suction type is selected for both the electromagnetic valves.

In that case, there is a possibility that jumping may occur in the low flow rate area because of the adoption of the electromagnetic valves of the forward suction type. However, although those electromagnetic valves are the forward suction type, if one electromagnetic valve having the relatively low maximum flow rate is selected, the flow rate of the gas flowable therethrough is low in itself, and thus, even if the jumping occurs, the amount of the jumping reflected as pressure fluctuations is also small.

As a result, even if only the electromagnetic valves of the forward suction type are selected, the maximum flow rate thereof is properly selected, which enables improved control accuracy in the low flow rate area and realizes the suppressed pressure fluctuations in the flow rate area more than the above flow rate.

In the fourth embodiment, the example is taken where the single electromagnetic valve 7 as the first electromagnetic valve and the single electromagnetic valve 8 as the second electromagnetic valve are used.

However, each of the first electromagnetic valve and the second electromagnetic valve does not have to be made of a single one, and instead may be composed of a plurality of ones.

For example, if the processing system is composed of three electromagnetic valves, it may be provided one electromagnetic valve covering the low flow rate area and two electromagnetic valves covering the remaining area.

Moreover, if the processing system is composed of four electromagnetic valves, it may be provided two electromagnetic valves of the forward suction type, each having the maximum flow rate of 10% as the electromagnetic valves covering the low flow rate area, and two electromagnetic valves of the forward suction type, each having the maximum flow rate of 40% as the electromagnetic valves covering the remaining area. In that case, the two electromagnetic valves of the forward suction type are driven, each having the maximum flow rate of 10%, until the flow rate of the purge passage reaches 20%, and the driving timing is selected with which the valves cancel the mutual pressure fluctuations. Moreover, in an area where the flow rate of the purge passage is 20% or more, the two electromagnetic valves of the forward suction type, each having the maximum flow rate of 40% should be similarly driven, in addition to these electromagnetic valves.

This enables reduction of the influence of jumping, and at suppression of the pressure fluctuations in the all flow rate areas.

It should also be appreciated that whereas in the above description, the example is given where the electromagnetic valves of the forward suction type are used for all of the four electromagnetic valves, a similar arrangement is practicable even in the event of using the reverse suction type for the all electromagnetic valves.

In the above embodiments, various examples are given of what type of electromagnetic valve should be selected as the first or the second electromagnetic valve, what maximum flow rate that the electromagnetic valves may take should be selected, how many electromagnetic valve should be respectively provided, and how to control by using these electromagnetic valves.

However, what type of electromagnetic valve should be selected as the first and the second electromagnetic valves, and how to control are not limited thereto, and various modifications or combinations are possible within the scope of the spirit of the present invention.

It should be understood that the present invention is not limited to the selection of the first and the second electromagnetic valve and the manner of the control of those valves, and various modifications or combinations are possible in the various arrangements shown in the above-mentioned embodiments within the scope of the spirit of the present invention.

INDUSTRIAL APPLICABILITY

The fuel-evaporated gas processing system and the electromagnetic valve device according to the present invention are used for motor engines, excellent in efficient suppression of the pressure pulsations, suitable for reducing the degradation of the air fuel ratio control and vibrations and pulse sound of their piping, and further qualified for mounting compact engines.

The invention claimed is:

1. A fuel-evaporated gas processing system taking in volatilized gas evaporated in a fuel tank, temporarily adsorbing the gas in a canister, and supplying the evaporated gas in the canister to an intake system of an engine, the fuel-evaporated gas processing system comprising:

an input port taking in the evaporated gas from the fuel tank;

output ports supplying the evaporated gas taken in through the input port to the intake system of the engine;

a chamber interposed between the input port and the output ports;

an electromagnetic valve device including at least first and second electromagnetic valves disposed in the connection between the input port or the output ports and the chamber, either of the input port or the output ports being branched off into a plurality of sections, and perform opening and closing operations in response to a driving signal; and a valve control means for driving the first and the second electromagnetic valves of the electromagnetic valve device.

2. The fuel-evaporated gas processing system according to claim 1, wherein the first and the second electromagnetic valves have almost the same flow rate characteristic.

3. The fuel-evaporated gas processing system according to claim 1, wherein the valve control means is for differencing control signal of the first electromagnetic valve and that of the second electromagnetic valve, and controls to have the first electromagnetic valve and the second electromagnetic valve have the control timing mutually different from each other in a canceling direction of pressure fluctuations of the evaporated gas caused by the opening and closing operations of the first electromagnetic valve.

4. The fuel-evaporated gas processing system according to claim 3, wherein either the first electromagnetic valve or the second electromagnetic valve is a reverse suction type in which negative pressure is applied in an opposite direction to a valve closing direction of an armature, and when the flow rate of the gas flowing through the electromagnetic valve device is equal to or less than a predetermined flow rate, the electromagnetic valve of the reverse suction type is driven.

5. The fuel-evaporated gas processing system according to claim 4, wherein the electromagnetic valve of the reverse suction type has the maximum flow rate smaller than that of the other electromagnetic valve.

6. The fuel-evaporated gas processing system according to claim 3, wherein either the first electromagnetic valve or the second electromagnetic valve has the maximum flow rate smaller than that of the other electromagnetic valve.

7. The fuel-evaporated gas processing system according to claim 1, wherein the chamber is formed of a housing section provided in the electromagnetic valve device and a cap section of the housing section.

8. The fuel-evaporated gas processing system according to claim 1, wherein the first electromagnetic valve is composed of a plurality of electromagnetic valves or the second electromagnetic valve is composed of a plurality of electromagnetic valves.

9. An electromagnetic valve device comprising:

an input port taking in volatilized gas from a fuel tank;

output ports supplying the evaporated gas taken in through the input port to an intake system of an engine;

a chamber interposed between the input port and the output ports; and at least first and second electromagnetic valves disposed in the connection between the input port or the output ports and the chamber, either of the input port or the output ports being branched off into a plurality of sections, and perform opening and closing operations in response to a driving signal.

10. The electromagnetic valve device according to claim 9, wherein the first and the second electromagnetic valves each comprise a terminal used for driving.

11. The electromagnetic valve device according to claim 9, wherein the first and the second electromagnetic valves have almost the same flow rate characteristic.

12. The electromagnetic valve device according to claim 9, wherein the first electromagnetic valve or the second electromagnetic valve is the reverse suction type to which negative pressure is applied in an opposite direction to a valve closing direction of an armature.

13. The electromagnetic valve device according to claim 12, wherein the electromagnetic valve of the reverse suction type has the maximum flow rate smaller than that of the other electromagnetic valve.

14. The electromagnetic valve device according to claim 9, wherein the first electromagnetic valve or the second electromagnetic valve has the maximum flow rate smaller than that of the other electromagnetic valve.

15. The electromagnetic valve device according to claim 9, wherein the chamber is formed of a housing section of a valve unit formed by integrally unitizing at least two electromagnetic valves, and a cap section of the housing section.

16. The electromagnetic valve device according to claim 9, wherein the first electromagnetic valve is composed of a plurality of electromagnetic valves or the second electromagnetic valve is composed of a plurality of electromagnetic valves.

* * * * *